United States Patent [19]

Gino

[11] Patent Number: 4,570,418

[45] Date of Patent: Feb. 18, 1986

[54] DEVICE FOR THE AUTOMATIC BOXING OF BAGS OR SACHETS INTO CONTAINERS

[76] Inventor: Donati Gino, Via Carpignola, 64, a Cattolica (FO), Italy

[21] Appl. No.: 401,944

[22] Filed: Jul. 26, 1982

[30] Foreign Application Priority Data

Jul. 27, 1981 [IT] Italy ..... 631 A/81

[51] Int. Cl.[4] ..... B65B 61/06; B65B 5/10

[52] U.S. Cl. ..... 53/435; 53/475; 53/520; 53/244

[58] Field of Search ..... 53/520, 513, 248, 244, 53/459, 252, 570, 435, 475; 83/167, 84, 282, 157, 437, 453, 276

[56] References Cited

U.S. PATENT DOCUMENTS

| | | | |
|---|---|---|---|
| 3,126,816 | 3/1964 | Thompson | 83/157 X |
| 3,194,098 | 7/1965 | Kimball et al. | 83/167 X |
| 3,579,948 | 5/1971 | Lerner | 53/459 |
| 3,880,031 | 4/1975 | Rodermund et al. | 83/167 X |
| 3,926,081 | 12/1975 | Roberts | 83/167 X |
| 4,329,830 | 5/1982 | Omori | 53/459 X |

*Primary Examiner*—Horace M. Culver
*Attorney, Agent, or Firm*—Leonard Bloom

[57] ABSTRACT

The invention relates to a device for the automatic boxing of bags or sachets into cardboard containers, fed by continuous strips of bags or sachets coming from the packaging machine.

The device according to the invention provides no means of removal, transport and boxing of the cut sachets since the containers to be filled, according to this invention, stop directly below the cutting edge, under the right-angled projection of the first sachet in the row which is to be cut. Therefore the stack inside the container is formed automatically by the sachets simply dropping one on top of the other, through the force of gravity.

9 Claims, 2 Drawing Figures

DEVICE FOR THE AUTOMATIC BOXING OF BAGS OR SACHETS INTO CONTAINERS

This application for an industrial patent has for its object a mechanical device for the automatic boxing of sachets or bags into cardboard containers, taking them directly they leave the packaging machine.

There is an increasing demand on the market for food and pharmaceutical products to be prepared in hermetically sealed paper sachets. There is, above all, a growing tendency to supply medicinal products in powder or soluble granular form in single dose sachets.

For a better evaluation of the merits and advantages of the machine which is the object of this invention in comparison to the machines currently in operation, it should be assumed that a continuous strip of sachets or bags, which are vertically and horizontally aligned in rows, leave the machine provided for the automatic packaging of the product.

According to one technique, this continuous strip is cut both transversely and longitudinally as it leaves the packaging machines, so obtaining single or double sachets which are taken by pincers or suckers and stacked in the required number in trays or containers arranged for their conveyance to the boxing machine.

Difficulties are experienced with this method largely due to the irregular form of each sachet which during its conveyance may easily slip from its correct horizontal position in the stack, thus causing hold-ups both during conveyance and during the introduction of the stack into the cardboard box.

According to another technique, the continuous strip of sachets or bags which leaves the packaging machine is perforated both transversely and longitudinally between each sachet (like a sheet of postage stamps). This allows the sachets to be torn apart either singly or in pairs and then taken and placed into the packing boxes by means of pincers or suckers.

The difficulties experienced here concern the stage where the sachets or bags are torn apart as it is not easy to obtain a correct and even perforation which would guarantee the continuous movement of the sheet of sachets together with a regular tearing action.

The aim of this invention is to eliminate the above-mentioned difficulties by means of a mechanical device which ensures an uninterrupted process during the automatic boxing of paper sachets or bags into cardboard containers.

A further aim of this invention is to provide an independently operating machine which may be directly coupled with a standard packaging machine, thus obtaining a continuous process beginning with the packaging of the product and proceeding to the boxing in cardboard containers holding the required number.

According to our invention the device consists of:

a cutting point whereby a vertical blade moving downwards cuts the satchets which are held at the cutting edge;

the aforesaid cutting point has an intermittent feeding mechanism which regularly moves one single or double sachet at a time, in one or more rows, and which is able to stop the sachets when suspended on the cutting edge;

a stopping point for the cardboard containers which is found directly under the edge of the cutting point where the sachets are held ready for cutting.

The stacking of the sachets or bags inside the packing box is therefore carried out automatically, in accordance with the instant invention, since with the force of gravity they simply drop one on top of the other as they are cut.

This boxing system eliminates the difficulties already explained which, in one case, occur during the conveyance of unsteady stacks, and in the other case, occur during the process of tearing perforated strips of sachets.

At the same time it eliminates the need for the use of any instruments (pincers, suckers etc.) to take the sachets or bags from the cutting point to the boxing point. This simplifies both the structure and the maintenance of the machine and considerably reduces the manufacturing costs.

The attached drawings are for a clearer illustration and exemplify only one preferred embodiment of the instant invention.

Figure 1:
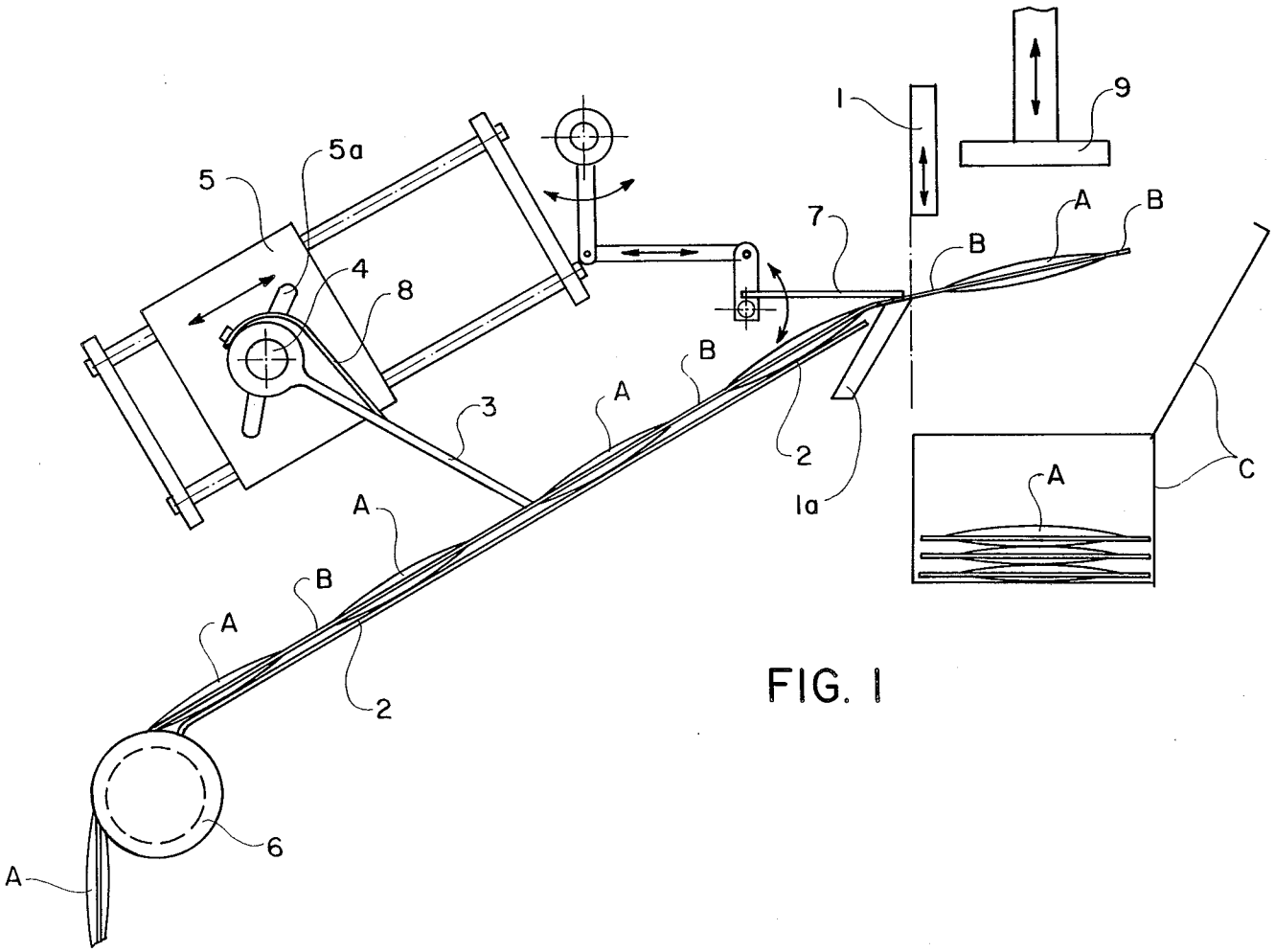
FIG. 1 is a perspective view of the machine, in accordance with the invention, shown schematically.
Figure 2:
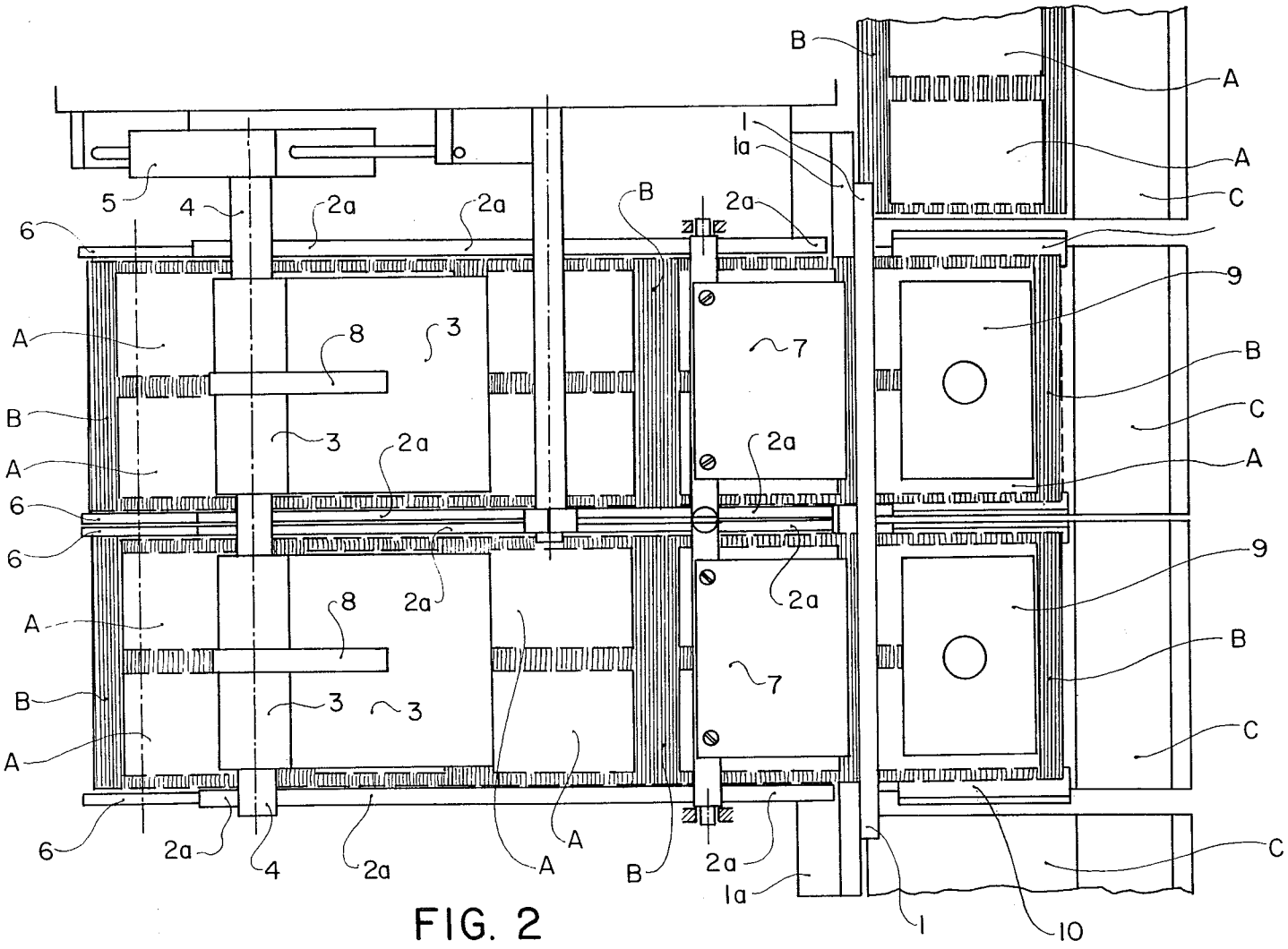
FIG. 2 is a top view of the machine, in accordance with the invention, shown schematically.

In the embodiment of the invention illustrated in the aforesaid figures, it is assumed that the machine has two moving paths or tracks fed with longitudinal strips of double sachets.

With reference to the aforesaid figures, the mechanical device according to the instant invention is comprised of:

(a) a cutting point whereby a blade (1) "guillotines" the strip of sachets or bags (A) along the central line of the transversal sealing seam (B) found between each sachet or bag;

(b) a feeding mechanism for the aforesaid cutting point consisting of an inclined plane (2) which may have one or more moving paths, according to requirements, with side panels **(2*a*) which terminate just before the blade stop (1*a*). A spatula (3) which is constantly held down by a spring (8), slides along each path. Said spatula, on a horizontal shaft (4) above the inclined plane (2), is fixed to a slide (5) which is given an alternating movement by means of a crank mechanism connecting rod-crank. The slide (5) and its integral shaft (4) make alternate runs parallel to the inclined plane (2). Rollers (6) to guide the continuous strips of sachets (A) coming from the packaging machine, are provided for each moving path and situated at the bottom of the inclined plane (2). The feeding mechanism also provides a grip cheek (7) for each moving path actioned by a crank mechanism which holds the first sachet or double sachet of the strip lying on the inclined plane (2), on the blade stop (1*a*)** for an established period of time;

(c) a stopping point for the cardboard containers (C) which stop directly under the above-mentioned cutting point in correspondence with each moving path. Said containers are aligned so as to be perpendicular to the moving plane of the sachets, in channels fitted with pushers with a controllable intermittent feed movement.

It should be noted that the angle of incidence of the spatula (3) on the inclined plane (2) may be regulated by moving the shaft (4) inside the apposite slot **(5*a*) provided on the slide (5)**.

Having examined the structure of the mechanical device according to this invention, the method of procedure shall now be considered.

The automatic packaging machine has been appropriately adapted to cut the sheet of sachets leaving it into various longitudinal strips of one or more sachets.

These strips are conveyed on to the plane (2) of the device herein described.

It is assumed that the cycle begins with the downward stroke of the blade (1).

During the cutting process the first sachets of each moving path which have been conveyed beyond the cutting edge, are held on the blade stop (1*a*) along their transversal sealing seam by the aforesaid grip cheek (7).

While the blade (1) is dropping and cutting the slide (5) makes its idle return stroke downwards and consequently the spatula (3) slides over the row of sachets found underneath. These sachets or bags cannot move backwards as they are held at the top of the plane (2) by the grip cheek (7).

During the backward stroke of the slide (5), the spatula (3) stops about half-way along the transversal sealing seam (B), already referred to, so that during the following upstroke the spatula (3) slides over this seam and begins to push the row of sachets forward, but only when it meets the ridge which has been formed on the aforementioned sealing seam.

The forming and the interception of this ridge is also assisted by the presence of the product inside the sachet, as, first, the conveyance is in an upward direction and the sachets are vertical, then, on the inclined plane (2) with the force of gravity the product accumulates at the bottom of the sachet against the sealing seam.

The aforesaid settling of the product at the bottom of the sachet occurs during the upward conveyance of the strips when the sachets are vertical, therefore the inclined plane (2) could, according to another embodiment, be horizontal.

During its active stoke the spatula (3) pushes forward the row of sachets until the first sachets are at the cutting edge where they are held by the grip cheek (7) and suspended over the box into which they will be introduced once cut.

On considering the above it can be noted that the active stroke of the spatula (3) is in fact shorter than its mechanical stroke and that the excess is dissipated, at each cycle, by sliding over the sealing seam (B) which offers no resistance to the spatula until the aforesaid ridge is reached.

This method of procedure allows for one sachet at a time to move forward by a distance equal to its own length, independently from the mechanical run of the spatula and from the forward movement had during the preceding cycle.

This prevents the sachets from bunching together as a result of possible differences in form on account of the paper from which they are made being stretched, crumpled or folded whilst in the packaging machine.

In conclusion it may be summarized that the upward and downward stroke of the blade (1) is simultaneous to the idle backward stroke of the spatula (3) with the row of sachets held by the lowered grip cheek (7), while the the active forward stroke of the spatula (3) occurs with the grip cheek (7) and the cutting blade lifted.

The device according to this invention also provides a "pusher" (9) actioned by a cam which descends at the same time as the blade (1) through free fall or assisted by a return spring.

Said "pusher" (9) continues its run downwards beyond the cutting edge and conducts the cut sachets into the cardboard container (C) found underneath. At each cycle it applies pressure on the sachets which are forming a stack inside said container.

In order to ensure an even horizontal layering of the sachets inside their containers side rests (10) have been provided on which the sachets briefly stop after having been cut. From these rests (10) they are then taken and pushed down into the container by the "pusher" during its rapid downward stroke.

It should be clear that this specification refers to only one preferred embodiment of the machine according to this invention and no details of the construction concerning the machine members or cams and their operation have been supplied in that they are not essential for the explanation of the instant invention.

Therefore various modifications and alternatives, above all concerning the construction, may be had and still come within the scope of this invention herein described with reference to and as indicated by the accompanying drawings.

I claim:

1. An apparatus for the automatic boxing into at least one container individual bags filled with granular material from a continuous strip of bags having a sealing strip between said bags, comprising cutter means for cutting along a central line of said sealing strip at a given cutting location, feeding means for said cutting location having an inclined surface and at least one moving path thereon for supporting said continuous strip for movement thereon, holding means for holding a first of said individual bags of said continuous strip at said cutting location, said at least one container being positioned beneath said cutting location to receive by force of gravity said individual bags upon being cut by said cutting means, and pusher means adjacent said cutting means and moving therewith in a direction for assisting the gravity fall of said individual bags towards a stacked array in said at least one container.

2. An apparatus according to claim 1, wherein said feeding means comprises a shifting means for incrementally shifting said continuous strip along said moving path approximately the length of each of said individual bags.

3. An apparatus according to claim 1, wherein said at least one container is aligned to be perpendicular to the direction of movement of said at least one path.

4. An apparatus according to claim 1, wherein said at least one path on said feeding means comprise side panels.

5. An apparatus according to claim 1, further comprising an arresting means between said cutting location and said at least one container for briefly arresting the fall of said individual bags during their descent into said container.

6. An apparatus according to claim 1, wherein said pusher means moves into said at least one container for applying pressure on said stacked array of said individual bags contained therein.

7. An apparatus according to claim 2, wherein said shifting means comprises a pivotal means engaging said continuous strip, wherein said shifting means shifts in a backward direction simultaneously with a downward and an upward motion of said cutting means and slides over said continuous strip of bags along the long axis thereof while said holding means holds said first bag, and wherein said shifting means shifts in a forward direction when said holding means disengages said first bag, and said pivotal means slides along said sealing strip until said pivotal means reaches a ridge thereon formed by said material in said bags and pushes said continuous strip thereby until said first bag thereof reaches said cutting location and said holding means again holds said first bag.

8. An apparatus according to claim 1, further comprising a means for the conveyance of said continuous strip of bags onto said inclined surface having a vertical and upward movement, to allow, through the force of gravity, for said material to accumulate at the bottom of said bags against said sealing seam between said bags.

9. A method for automatically boxing individual bags filled with granular material from at least one continuous strip of bags having a sealing strip between said bags into at least one container, comprising the steps of, incrementally shifting said continuous strip at lengths corresponding to the length of each of said individual bags to a cutter location positioning said at least one container beneath said cutter location holding said continuous strip between incremental shifts, cutting said sealing strip adjacent a first bag of said continuous strip to allow each of said individual bags to fall by force of gravity into said at least one container, briefly arresting the fall of said individual bags before said bags enter said container, and assisting the fall of said bags by pushing said bags towards a stacked array in said at least one container.

* * * * *